United States Patent [19]

Schmid et al.

[11] 4,388,170

[45] Jun. 14, 1983

[54] PROCESS FOR PRODUCING LOWER-MOLECULAR-WEIGHT HYDROCARBONS FROM HIGHER MOLECULAR-WEIGHT HYDROCARBONS AND AUXILIARY AGENT THEREFOR

[76] Inventors: Klaus Schmid, Libauerstr. 27, 89000 Munich 81; Hannes Kneissl, Kurstr. 18, 8184 Gmund am Tegernsee, both of Fed. Rep. of Germany

[21] Appl. No.: 290,812

[22] PCT Filed: Nov. 27, 1980

[86] PCT No.: PCT/EP80/00140

§ 371 Date: Aug. 3, 1981

§ 102(e) Date: Aug. 3, 1981

[87] PCT Pub. No.: WO81/01576

PCT Pub. Date: Jun. 11, 1981

[30] Foreign Application Priority Data

Dec. 4, 1979 [DE] Fed. Rep. of Germany ..... 2948789
May 5, 1980 [DE] Fed. Rep. of Germany ..... 3017170

[51] Int. Cl.[3] ..... C10G 1/04; C10G 1/06

[52] U.S. Cl. ..... 208/8 LE; 208/11 LE

[58] Field of Search ..... 208/8 R, 8 LE, 11 LE, 208/11 R

[56] References Cited

FOREIGN PATENT DOCUMENTS 2803985 8/1979 Fed. Rep. of Germany ... 208/8 LE
2948789 1/1981 Fed. Rep. of Germany ... 208/8 LE
3008446 1/1981 Fed. Rep. of Germany ... 208/8 LE

*Primary Examiner*—Delbert E. Gantz
*Assistant Examiner*—Asokkumar Pal
*Attorney, Agent, or Firm*—Ladas & Parry

[57] ABSTRACT

Production of lower-molecular-weight hydrocarbons from higher-molecular-weight hydrocarbonaceous material by heating at an elevated temperature in the presences of a guanidinium compound such as guanidinium carbonate, oleate, palmitate stearate or phenolate. The invention is especially applicable to coal liquefaction and gasification.

17 Claims, 1 Drawing Figure

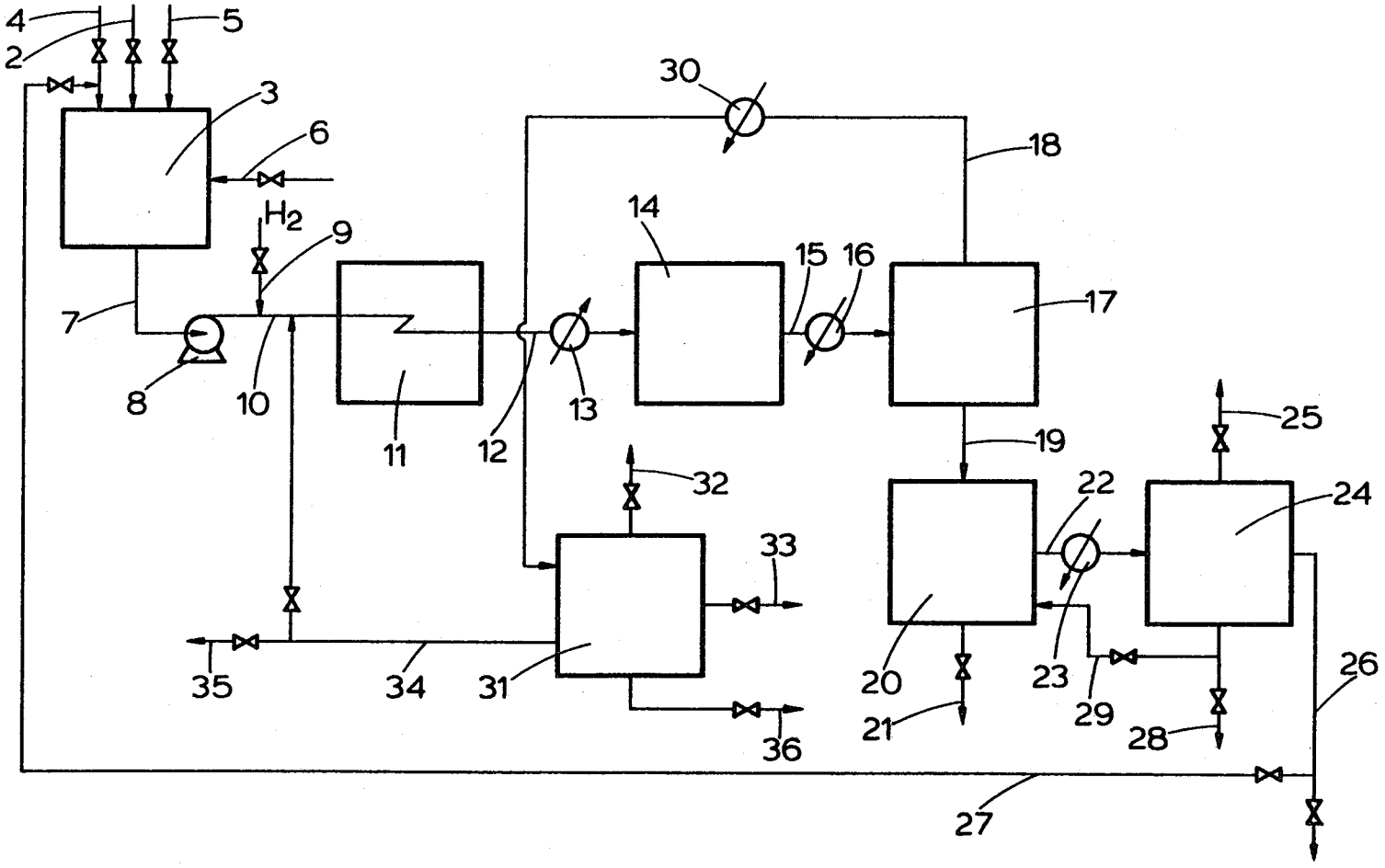
$H_2$

PROCESS FOR PRODUCING LOWER-MOLECULAR-WEIGHT HYDROCARBONS FROM HIGHER MOLECULAR-WEIGHT HYDROCARBONS AND AUXILIARY AGENT THEREFOR

This invention pertains to an improved process for producing lower-molecular-weight hydrocarbons from higher-molecular-weight hydrocarbons by the use of novel additives or auxiliary reagents, and to such additives or reagents per se. "High-molecular-weight hydrocarbons", as used herein, means solid and liquid fossil-fuel raw materials such as coal, minerals (e.g. petroleum) oils, bituminous matter, oil shale, tar sands and the like.

These hydrocarbon materials are customarily increased in value by lowering their molecular weight. Therefore more and more steps are being taken to this end.

Work in the prior art for the improvement of economics of coal-liquefaction processes, described, for example, in DE-OS No. 27 11 105 and DE-OS No. 28 03 983 has concentrated on process variants such as pressure, temperature, property of input coal, choice of hydrogenation gases, mode of conducting the reaction, i.e. process engineering and especially with respect to the employed catalysts.

The invention has as an object to promote, in the above-mentioned processes, the conversion of high-molecular-weight hydrocarbon mixtures into lower ones by using auxiliary agents, thus achieving a higher profitability because of the better C:H-ratio in the end products.

Another object is to provide novel auxiliary agents for the purpose mentioned.

Another object is to provide an improved process for the liquefaction and/or gasification of coal.

A further object is to increase the yield or conversion per pass in the liquefaction of coal.

Other objects and advantages will become apparent to those skilled in the art upon reading this specification.

According to this invention, a process is provided for obtaining relatively low-molecular-weight hydrocarbons from higher-molecular-weight hydrocarbons by heating in the presence of guanidinium compounds as auxiliary agents.

By "auxiliary agents" is meant, in contradistinction to catalysts, substances which not only function through their mere presence, but are reacted or used up in the course of the process or its physical and/or chemical reactions.

It was found that the guanidinium compounds operating according to the invention as auxiliary agents have the distinct function to labilize and/or crack bonding forces in high-molecular-weight hydrocarbons, thus directing the processes towards an enrichment in yield of lighter, lower-molecular-weight hydrocarbons. Here "bonding forces" are meant in a broad sense; their nature can be of physical or chemical character, as well as transition types between both of them. By the labilisation or loosening to the complete cleavage of bonding forces, the initially defined producing of lower-molecular-weight hydrocarbons is directly facilitated. Additionally, the solubilisation of the hydrocarbons is increased by the use of guanidinium compounds, thus apparently additionally facilitating the production process in a concrete manner. Thus, for example, in coal liquefaction, where the coal is first suspended in an oil to form a slurry, the guanidinium compound promotes the release and/or solution of hydrocarbonaceous matter and promotes an increase in the subsequent conversion per pass, and a decrease in the necessity for recycling. The increased degree of release or dissolution can be as high as 30% of coal (by weight) as compared to 1 or 2% in many prior art processes.

According to the invention, the guanidinium compounds can be added per se or in solution in known solvents, e.g. water in the case of the carbonate. The total amount of guanidinium used is up to 10 weight percent, preferably from 0.1 to 3 weight percent based on the weight of starting material. When guanidinium compound is used in solution, the concentration thereof is up to 10 weight percent, preferably 0,01 to 3 weight percent, based on the solvent. The applied amount is governed by economic factors.

Under the aspect of economics guanidinium carbonate is the preferred auxiliary agent because it is the cheapest of all guanidinium-compounds, Besides that it has further important advantages. Guanidinium carbonate does not cause corrosion nor pollution. Moreover its decomposition can be regulated rather precisely, thus offering a precise control tool. Moreover the basic character of the carbonate part gives the guanidinium carbonate an additional reactivity, and is used advantageously in conversion reactions with acid groups. An interesting side-effect is simultaneously generated, simply by the fact that, because of the acid character of phenolic and/or thiophenolic groups in a high molecular hydrocarbon mixture of fossil origin a carbon dioxide generation in situ takes place during the reaction with guanidinium carbonate, thus causing a loosening "bubble-effect".

To reinforce the interaction between hydrocarbon mixtures to be processed and the guanidinium compound, it can be desirable to apply guanidinium-carbonate in combination with other guanidinium compounds, especially in combination with carboxylic acid, preferably fatty acid guanidinium salts and/or together with guanidinium phenolate. It is not necessary to manufacture the corresponding guanidinium compounds in exact stoichiometric ratios and then add them to the reaction mixture in strict weight relations. The composition and dosage amount of the optimal proportions are rather governed by economic factors. This fact constitutes an essential advantage of the invention, opening up the opportunity of varying the amounts and mixing ratios of the guanidinium compounds, applied according to the invention, in a wide range, strictly based upon economic factors without direct loss of efficiency.

A further, highly economic application is given by adding, with the guanidinium carbonate, free acids, e.g. carboxylic acids, especially fatty acids, sulfonic acids and/or phenols as well as certain acidic alcohols. The weight ratio of guanidinium carbonate to the acidic materials can be in the range 0.1:1 to 10:1.

By use of guanidinium carbonate in stoichiometric deficiency with respect to the acidic compound, a mixture of unreacted starting material and corresponding guanidinium compound is formed, and functions as the auxiliary agent according to the invention. In the case of guanidinium carbonate in excess, a mixture of guanidinium-carbonate and corresponding guanidinium-compound forms and functions similarly.

A high degree of profitability is realized if the above-mentioned starting chemicals are waste or residual products. The abundantly occuring waste fatty acids and crude tar acids are adaptable as highly economic starting products for the reaction with guanidinium carbonate.

Independently from the different forms of the applied guanidinium compounds, the invention stems importantly from the fact, that guanidinium compounds, because of the chemical structure of the guanidinium cation, exert a fragmenting power on high-molecular-weight hydrocarbon mixtures, thus favouring especially the production of lower-molecular-weight hydrocarbons. Besides that, and overlapping therewith, an additional power of guanidinium compounds prevails in increasing the solubilisation of hydrocarbon mixtures.

A specially preferred field of application of the invention is the liquefaction or gasification of coal, including those gasification processes, wherein the coal is reacted in aqueous suspension.

The use of guanidinium compounds as auxiliary agents in coal liquefaction and gasification makes it possible to improve process economics. The guanidinium compounds essentially function to facilitate the desired break-up of bonding forces within the molecular lattice of coal and to accelerate the saturation of sites where chemical bonds have been broken. By this means, the advantage is achieved that the need for catalysts, as in most prior art processes, is reduced or even abolished, and that it is moreover possible to use, for coal liquefaction, instead of pure molecular hydrogen, cheaper hydrogenation gases. Both aspects lower directly the cost burdens of hitherto known processes.

The scope of the invention includes, for the liquefaction of coal, the use of certain guanidinium compounds alone or together with other guanidinium compounds. In any case, the preferred total input amount is up to 10 weight percent, preferably 0.1 to 3 weight percent, based on dry weight of coal charged.

The guanidinium compounds according to the invention decompose at elevated temperatures to highly reactive decomposition products, which can favor the hydrogenation reaction. This function is effected very distinctly by use of guanidinium carbonate. In comparison to the chloride, sulfate or nitrate, which are also considered in this context, the guanidinium carbonate is superior for reasons of prevention of corrosion and pollution and because of a more regulatable decomposition, as mentioned already earlier herein. Moreover it is reasonable in price, as previously stated.

The guanidinium carbonate can be applied alone as auxiliary agent. Very advantageous, however, is the application in combination with fatty-acid guanidinium salts e.g. palmitates, oleates and steareates. By the use of fatty-acid guanidinium salts, e.g. stearates, the interaction of guanidinium carbonate with the hydrocarbon mixture is improved in the sense of a solubilising aid at temperatures below 150° C. This contributes advantageously to stabilising the coal-mix-oil-suspension, used in coal-liquefaction, and directs the heterogeneous reaction of hydrogen with coal more towards an homogeneous reaction.

The precise ratio of guanidinium carbonate to the better solubilising guanidinium compound(s) depends on the details of the specific liquefaction or gasification process and the properties of the raw materials.

The preferred weight ratio of guanidinium carbonate to fatty-acid guanidinium salt, e.g. stearate is from 0.3:1 to 3:1, preferably about 3:1. Generally the guanidinium compounds used according to the invention are added at the initial stage of the liquefaction process. They can, for example, be added together with the catalyst if a catalyst is used. Thus a suitable dosage site in a process according to DE-OS No. 28 03 985 and DE-OS No. 27 11 105, which the invention is especially suited for, is the mixing-container 2, in more detail described there.

The accompanying drawing is a schematic flowsheet, illustrating a preferred embodiment of the invention as applied to a coal hydrogenation process. The flow sheet has been simplified for purposes of clarity since the general flow arrangements for processes of this type have been well known in the art for a number of years. For further details in this respect, reference is made to DE-OS Nos. 27 11 105 and 28 03 985 for further description of two examples of processes in the prior art.

As shown in the drawing, coal is fed through inlet 2 into mixing zone 3. A suitable hydrocarbon oil is supplied through inlet 4 to form a suspension of the coal, which has been ground, in means not shown, to an average particle size of a few microns. Although a catalyst is not absolutely necessary for operation of the invention, a catalyst, such as an iron compound, can be supplied, if desired, through inlet 5. The auxiliary agent, a guanidinium compound, is supplied through inlet 6. In mixing zone 3, the named materials are mixed to form a substantially uniform, pumpable, solid-in-liquid suspension.

Mixing zone 3 can comprise any mixing means and metering means, the identity and nature of which are well known in the prior art.

The resulting suspension or slurry is passed through conduit 7 to pump 8, which increases the pressure of the slurry to a value of the order of 300 bar. Hydrogen is added through inlet 9 in an amount in the range 1000 to 1500 $Nm^3$ per ton coal. The resulting mixture is passed through conduit 10 to heating-holding zone 11, which can be any known type of heat exchanger or furnace used in the art for heating a coal slurry. It can be a single unit or a series of several units or stages.

The use of heating-holding zone 11 constitutes a preferred feature of this invention. In heating-holding zone 11, the slurry is held at a temperature in the range 100° to 300° C., optimally at about 200° C., for a time in the range 1 to 30 minutes. This heating-holding steps maximizes the effectiveness of the guanidine compound and increases the conversion per pass in the subsequent hydrogenation step.

The resulting mixture is passed through conduit 12 and heater 13 to hydrogenation zone 14 wherein the hydrogenation proper of the coal to produce liquid and gaseous hydrocarbons takes place. Conditions of temperature, pressure and residence time for this purpose are well known in this art and form no part of this invention. However, representative conditions are temperatures in the range 250° -500° C. pressures in the range 10–300 bar and times in the conventional range, e.g. 0.1 to 60 minutes. It is to be noted, however, that the increased release and/or dissolution of hydrocarbonaceous matter and consequently increased conversion per pass at any set of reaction conditions also makes it possible to effect the hydrogenation at milder conditions than was feasible in prior art processes.

The reaction mixture comprises coal, ash, hydrocarbons and hydrogen and can also contain carbon dioxide, water, hydrogen sulfide and/or ammonia. It is passed through conduit 15 and cooler 16 to separation zone 17. There, the normally gaseous and normally liquid components are separated from the normally solid components, i.e. coal and ash, together with accompanying heavy bituminous matter. The normally gaseous and normally liquid products are withdrawn as vapour through conduit 18. The solids are withdrawn through conduit 19. Cooler 16 can be omitted as desired.

Separation zone 17 comprises any known combination of equipment for the purpose stated, such as vaporizers, distillation columns, sumps, centrifuges and the like. This type of operation and appurtenant equipment are familiar to those skilled in the art and form no part of this invention.

The solid and/or bituminous residue is passed from separation zone 17 through line 19 to coking zone 20, which can comprise any desired number of coke ovens and appurtenant equipment known in the art. Coke is withdrawn as a product through outlet 21. Coke-oven gas is withdrawn through conduit 22 and condenser 23 and passed to separation zone 24, from which normally gaseous materials are withdrawn from outlet 25 and normally liquid intermediate-boiling hydrocarbon oil is withdrawn through outlet 26. This oil can be recovered as a product or recycled as a suspension oil through conduit 27. It ordinarily boils in the range 180°–300° C. Heavier oil boiling above 300° C. is withdrawn through outlet 28 for use as desired or recycled to the coking unit 20 through conduit 29. The gaseous materials in outlet 25 can be further processed, in known means not shown, for receovery of ammonia and/or other compounds, such as methane, ethane and propane.

Vapor fraction in conduit 18 is passed through condenser 30 to separation zone 31, which is usually one or more fractional distillation units. A normally gaseous fraction is withdrawn through outlet 32 and can be further purified to recover hydrogen, which can be recycled, through means not shown, to inlet 9 and for recovery of other gases, also in means not shown. A liquid hydrocarbon fraction boiling in the motor fuel range (e.g. 25°–180° C.) can be withdrawn as a product through outlet 33. A middle-range oil (boiling range 180°–300° C.) can be recycled to conduit 10 through 34 or withdrawn for other known uses through outlet 35. Higher-boiling material is withdrawn through outlet 36. Clearly, separation zone 31 can be operated to produce fractions of different boiling ranges from those herein disclosed.

The guanidinium compounds according to this invention are those wherein the anionic moiety or acid radical is selected from the group consisting of phenolates and thiophenolates (including condensed ring phenolates) having up to 20 carbon atoms, carbonate, aliphatic carboxylates having up to 20 carbon atoms, sulfonates, alcoholates having up to 20 carbon atoms, halides, sulfate, nitrate and the acid radicals of tar acids. Guanidinium carbonate is presently the most preferred auxiliary agent because of its relatively low price, its ready availability and its especially desirable action in the conversion process of this invention. Thus the ability of the carbonate to release carbon dioxide in the hydrogenation step described hereinbefore, the adaptability to function with acids such as the $C_{12}$ to $C_{18}$ fatty acids where added surface activity is desired and the ability to react with phenolic compounds present during coal liquefaction to form the corresponding phenolates, which are also highly desirable auxiliary agents, make the carbonate the preferred guanidinium compound. Guanidinium phenolate, which can be prepared by reacting the carbonate with phenol ($C_6H_5OH$), is also a highly valuable auxiliary agent.

Either or both of the amino nitrogen atoms of the guanidine moiety can be chemically bound to one or two hydrocarbyl substituents selected from the group consisting of phenyl and alkyl groups having up to 6 carbon atoms. The amino —N— unsubstituted guanidinium compounds are, however, presently preferred on account of their ready availability.

Thus quanidinium compounds in accordance with this invention can be represented by the formula

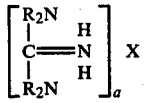

wherein X is selected from the group of acid radicals hereinbefore named, R is selected from the group consisting of hydrogen, phenyl, alkyl radicals having up to 6 carbon atoms, and carbamyl; and a is an integer representing the basicity of X, e.g. 1 when X is acetate, 2 when X is carbonate or sulfate etc.

Examples of such compounds are: Guanidinium carbonate, guanidinium palmitate, guanidinium oleate, guanidinium stearate, guanidinium chloride, guanidinium phenolate, N-methyl guanidinium carbonate, N,N-diethyl- guanidinium phenolate, N-dimethyl-guanidinium chloride, N-methyl, N-ethyl-guanidinium stearate, N-phenyl-guanidinium acetate, and N-carbamylguanidinium carbonate. These compounds can be prepared, for example, by reacting the corresponding guanidinium carbonate with the corresponding acid. The carbonate can be prepared by reacting the corresponding guanidine with carbon dioxide.

EXAMPLE

In a 2-liter autoclave, 200 g flame-coal, 300 g oil derived from coal (boiling range above 200° C.) and 3 g guanidinium stearate and in a second run, guanidinium-carbonate, i.e. 1,5% based on dry weight of coal charged, were mixed together under 30-bar $N_2$ pressure and intimate stirring. The temperature was raised to 180° C. and kept there for 30 minutes. After that period the temperature was raised to 200°, 250° and 300° C. and again kept at each temperature for 30 minutes. The tests were carried out for each end-temperature separately.

Each reaction-mixture was worked up in 30-g portions. These portions were washed out under reflux of 100 ml THF. After filtration the degree of dissolution of the coal was determined by the analytically measured enrichment of the ash-content of the residual coal.

| Data | Temperature, °C. | | |
|---|---|---|---|
| | 200 | 250 | 300 |
| Weight percent of dissolved coal treated with 1,5% guanidinium stearate | 14 | 16,5 | 19 |
| Weight percent of dissolved coal treated with 1,5% guanidinium carbonate | 12 | 14,5 | 17 |
| Weight percent of dissolved untreated coal (control) | 1,5 | 3 | 5 |

The enhanced dissolution demonstrated in the foregoing runs result in increased conversion per pass when the resulting mixture is subjected to hydrogenation. Similar results are obtained when hydrogen is subsituted for nitrogen in the foregoing runs, as is usually the practice.

The use of nitrogen, as in the runs described, enables one to demonstrate the individual action of the guanidinium compound, whereas if hydrogen were present, additional similar action by the hydrogen would partially mask the individual contribution of the guanidinium compound.

When the nitrogen in the effluent from the foregoing runs is replaced with hydrogen and the resulting mixture is subjected to conversion conditions at 450° C. and 300 bar, an improved yield of normally liquid hydrocarbon together with normally gaseous hydrocarbons is obtained.

We claim:

1. A process for producing liquid or gaseous lower-molecular-weight hydrocarbons from hydrocarbonanceous solid or liquid fossil-fuel raw materials having a higher molecular weight, which process comprises heating said hydrocarbonaceous materials together with hydrogen and a minor amount, up to 10 weight per cent based on the weight of said hydrocarbonaceous materials, of at least one guanidinium compound, at a temperature in the range 250° to 500° C., a pressure in the range 10 to 300 bar and a time in the range 0.1 to 60 minutes.

2. A process according to claim 1, wherein the guanidinium compound is guanidinium carbonate.

3. A process according to claim 1, wherein said at least one guanidinium compound comprises a guanidinium phenolate.

4. A process for producing liquid hydrocarbons from at least one normally solid material selected from the group consisting of coal, oil shale, bitumens and tar sand, which process comprises suspending said material, in particulate form, in a normally liquid hydrocarbon to form a slurry, and heating said slurry together with hydrogen and a minor amount, up to 10 weight percent based on the weight of said normally solid material, of at least one guanidinium compound, at a temperature in the range 250° to 500° C., a pressure in the range 10 to 300 bar and a time in the range 0.1 to 60 minutes.

5. A process according to claim 4 wherein said slurry is preheated, prior to the heating to 250°–500° C., at a lower temperature within the range 100° to 300° C. and held at this latter-mentioned temperature for a time in the range 1 to 30 minutes.

6. A process according to claim 5 wherein said minor amount is in the range 0.1 to 3 weight percent.

7. A process according to claim 4, wherein said at least one guanidinium compound comprises guanidinium carabonate.

8. A process according to claim 7 wherein said at least one guanidinium compound also comprises at least one guanidinium compound selected from the group consisting of guanidinium palmitate, guanidinium oleate and guanidinium stearate.

9. In a process comprising forming a slurry of coal in a liquid hydrocarbon oil, adding hydrogen to said slurry, holding the resulting mixture at a temperature in the range 100° to 300° C. for a time in the range 1 to 30 minutes, and subsequently heating the resulting mixture to a higher temperature in the range 250° to 500° C. and producing liquid hydrocarbons from said coal, the improvement which comprises adding a minor amount of a guanidinium compound to said slurry prior to the aforedescribed holding at a temperature in the range 100° to 300° C.

10. A process according to claim 9 wherein said minor amount is in the range up to 10 weight percent based on the weight of coal.

11. A process according to claim 10 wherein said minor amount is in the range 0.1 to 3 weight percent based on the weight of coal.

12. A process according to claim 9 wherein said guanidinium compound is guanidinium carbonate.

13. A process according to claim 4 wherein said guanidinium compound has up to 21 carbon atoms per molecule and in which the acid radical is selected from the group consisting of phenolates, thiophenolates carbonates, aliphatic carboxylates, sulfonates, alcolholates, halides, sulfate, nitrates and tar acids.

14. A process according to claim 4 wherein said at least one guanidinium compound is represented by the formula

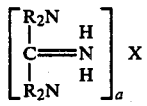

wherein R is selected from the groups consisting of hydrogen, phenyl, alkyl radicals containing up to 6 carbon atoms and carbamyl; X is an acidic radical selected from the group consisting of phenolates and thiophenolates having up to 20 carbon atoms, carbonate, aliphatic carboxylates having up to 20 carbon atoms, sulfates, alcoholates having up to 20 carbon atoms, halides, sulfate, sulfonate, nitrate, acid radicals or tar acids; and a is an integer representing the basicity of X.

15. A process for solubilizing hydrocarbonaceous matter in coal which process comprises heating said coal, in comminuted form, in suspension in a hydrocarbon oil, at a temperature in the range 100° to 300° C. and an elevated pressure, in the presence of a minor amount, up to 10 weight percent of the coal, of a guanidinium compound.

16. A process according to claim 15 wherein said guanidinium compound is guanidinium carbonate.

17. A process according to claim 15 wherein said guanidinum compound is guanidinium stearate.

* * * * *